US006206511B1

(12) United States Patent
Cook et al.

(10) Patent No.: US 6,206,511 B1
(45) Date of Patent: Mar. 27, 2001

(54) MULTIPLE-CARTRIDGE OFF-BOARD INK SUPPLIES FOR COLOR INK JET PRINTERS

(75) Inventors: William Paul Cook; Gary Allen Denton, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/100,043

(22) Filed: Jun. 19, 1998

(51) Int. Cl.[7] ..... B41J 2/175
(52) U.S. Cl. ..... 347/85
(58) Field of Search ..... 347/84–87, 7, 347/43

(56) References Cited

U.S. PATENT DOCUMENTS

| | | | | |
|---|---|---|---|---|
| 3,967,286 | | 6/1976 | Andersson . | |
| 4,422,085 | | 12/1983 | Sumitomo et al. . | |
| 4,714,931 | | 12/1987 | Erskine et al. | 346/75 |
| 4,831,389 | | 5/1989 | Chan . | |
| 4,929,969 | * | 5/1990 | Morris . | |
| 4,967,207 | | 10/1990 | Ruder . | |
| 4,968,998 | | 11/1990 | Allen . | |
| 5,136,305 | | 8/1992 | Ims . | |
| 5,369,429 | | 11/1994 | Erickson | 347/7 |
| 5,485,187 | * | 1/1996 | Okamura et al. | 347/85 |
| 5,710,579 | | 1/1998 | Hahs et al. . | |
| 6,106,109 | * | 8/2000 | Olazabal et al. | 347/85 |

FOREIGN PATENT DOCUMENTS 4-10945 * 1/1992 (JP) .

* cited by examiner

*Primary Examiner*—N. Le
*Assistant Examiner*—Judy Nguyen
(74) *Attorney, Agent, or Firm*—Michael T. Sanderson; B. Franklin Griffin

(57) ABSTRACT

A color ink jet printing device has an off-board ink reservoir for each color being printed. Each reservoir comprises at least two separately replaceable cartridges from which ink is supplied under positive pressure to refill replaceable printhead cartridges. A visual indicator is provided for each off-board cartridge to indicate when the cartridge is empty and this indicator is turned on if the ink supply in the cartridge is exhausted during a refill operation. Printing is not stopped until all off-board cartridges holding one color of ink are empty. At this time the empty cartridges that held any color ink, are replaced. After each operator intervention to replace empty cartridges, the volume of each color ink will be (N−1)/N of maximum reservoir capacity where N is an integer greater than one and represents the number of cartridges in the reservoir. The empty status of a reservoir cartridge is determined by sensing the level of ink in the printhead cartridge a fixed time interval after initiation of a refill operation from the reservoir cartridge.

14 Claims, 3 Drawing Sheets

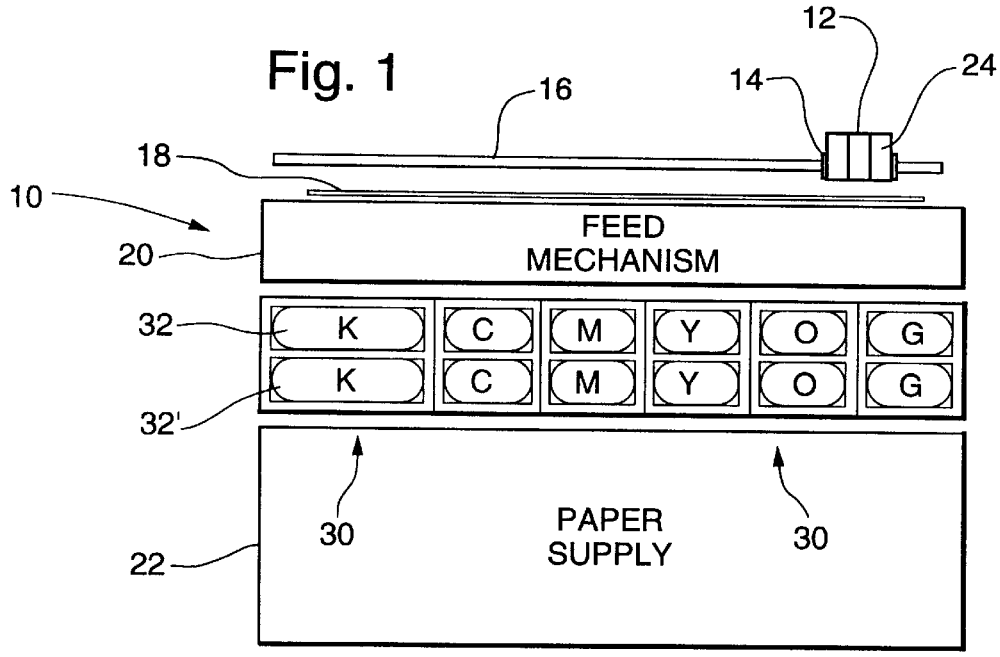
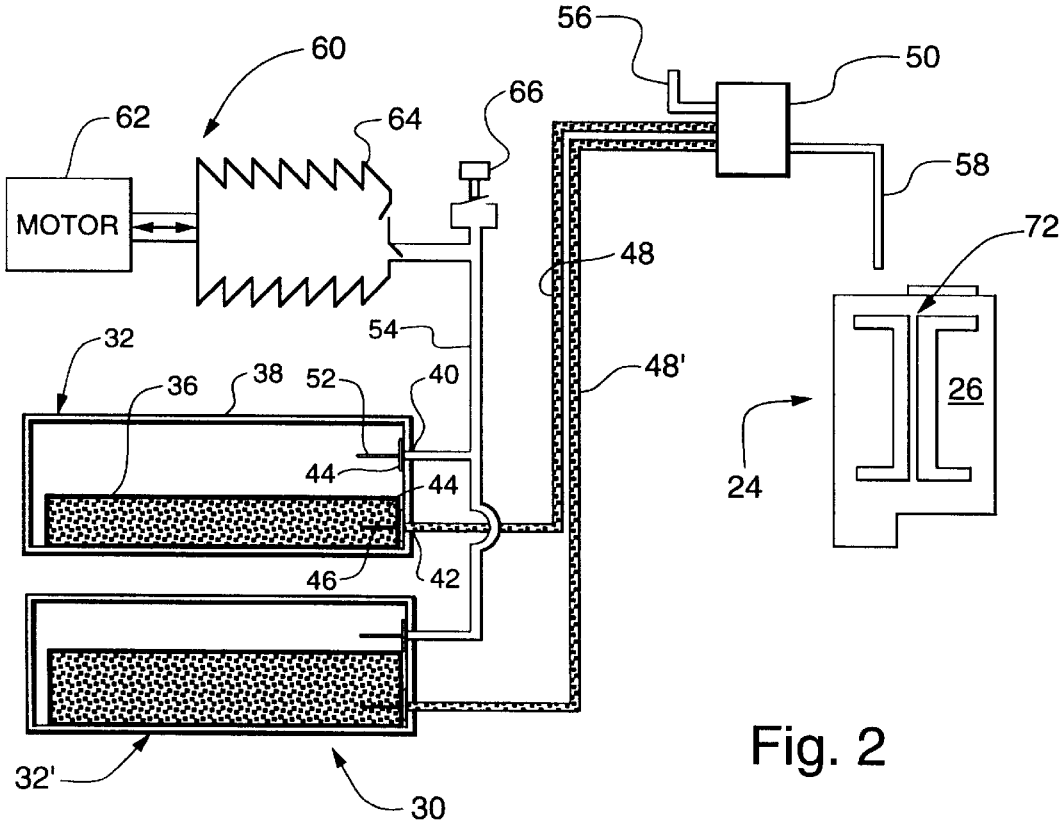
Fig. 2

MULTIPLE-CARTRIDGE OFF-BOARD INK SUPPLIES FOR COLOR INK JET PRINTERS

FIELD OF THE INVENTION

The invention relates to an ink supply system for a color ink jet printer of the type having off-board ink supplies for supplying inks to printhead cartridge reservoirs. Operator intervention to replenish off-board ink supplies is reduced by dividing the ink supply for each color into N separately replaceable cartridges, where N>1. When all off-board cartridges holding one color ink are empty, an operator intervenes to replace all off-board cartridges which held ink of the one color, and any empty cartridges which held inks of the other colors. After an intervention to replenish the exhausted supply of one color ink, the supply of ink of each color is at least (N−1)/N of its maximum capacity if the empty cartridges of other colors are also replaced during the intervention.

BACKGROUND OF THE INVENTION

Network ink jet printers use high carriage velocities and high acceleration rates to achieve printing at rates of over 10 pages per minute. To minimize the mass that must be accelerated, ink reservoirs are usually located off-board the carriage and various systems are implemented to transfer ink from the reservoirs to the printhead cartridges.

U.S. Pat. No. 5,369,429 employs a continuous ink supply system wherein flexible hoses or tubes connect a plurality of printhead cartridges to respective ones of a plurality of off-board ink reservoirs so that ink is supplied continuously to the cartridges as needed. U.S. Pat. Nos. 3,967,286, 4,967,207, 4,968,998 and 5,136,305 disclose intermittent ink supply systems wherein an ink jet cartridge is intermittently filled from an off-board reservoir by moving the cartridge to a service station where the reservoir is located.

The intermittent and continuous ink supply systems of the prior art share a common disadvantage when employed in color network printers. Because (1) ink is consumed relatively rapidly due to the high printing rates, (2) there are four or possibly six colors of ink being used, and (3) the ink supply for each color is an undivided ink supply, an operator must intervene in the printing process relatively frequently to replenish the off-board ink supplies, thus reducing the time the printer is available for printing. For example, in a printer capable of printing in four colors, and having an undivided off-board supply for each color holding enough ink for printing 20,000 prints or pages (5% coverage), an operator has to intervene in the printing process, on average, about every 5000 prints because the different colors of ink are not used up at the same time. In the worst case, a second intervention may be required only one page after a first intervention. This assumes that only the empty ink supply is replaced during an intervention. Of course all the reservoirs could be replaced during a given intervention but this would be wasteful of ink and increase the printing costs.

SUMMARY OF THE INVENTION

An object of the present invention is to provide an ink supply system for a color ink jet printer having off-board ink reservoirs, the supply system, as compared to prior art systems, requiring fewer operator interventions to replenish or replace the ink reservoirs.

Another object of the invention is to provide a color ink jet printer having an off-board ink reservoir for holding ink of each color, each reservoir comprising at least two separately replaceable cartridges.

A further object of the invention is to provide a color ink jet printing device having a printhead including printhead cartridge means mounted on-board a movable printhead carrier for ejecting a plurality of inks of different colors from ink reservoirs in the cartridge means, a like plurality of ink reservoirs located off-board the printhead carrier for refilling respective ones of the cartridge reservoirs with ink, the reservoirs off-board the carrier each comprising N separately replaceable off-board cartridges holding ink of the same color, N being an integer greater than one. The printhead cartridge means may comprise a plurality of disposable printhead cartridges, each holding ink of a different one of said colors, or a single cartridge having plural reservoirs.

Another object of the invention is to provide a color ink jet printing device having a printhead comprising a plurality of on-board cartridges mounted on-board a movable printhead carrier, each cartridge having therein an ink reservoir from which ink is ejected during printing, each reservoir holding ink of a different color, and an ink supply system for refilling the reservoirs in the on-board cartridges, the ink supply system comprising, for each of the on-board cartridges: an off-board ink reservoir comprising at least a first and a second off-board cartridge for holding ink of the same color, each off-board cartridge having an associated indicator for indicating to an operator when it is empty; a valve having first and second inputs connected to the first and second off-board cartridges and an output connected to a dispensing line through which ink flows to the ink reservoir of the on-board cartridge; first means for determining when the reservoir in the on-board cartridge is full and when the reservoir therein requires refilling; second means for determining when an off-board cartridge is empty; and, control means, responsive to the first means when the reservoir in the on-board cartridge requires refilling, for switching the valve so that ink may flow from the first off-board cartridge to the dispensing line, the control means being responsive to the second means for setting the indicator associated with the first off-board cartridge and switching the valve so that ink may flow from the second off-board cartridge to the dispensing line if the second means determines that the first off-board cartridge is empty. The control means comprises means for determining if all off-board cartridges holding ink of one color are empty and, if so, stopping the printing so that an operator may intervene and replace not only all the off-board cartridges which held the one color ink but also any empty cartridges which held inks of other colors.

Assuming N off-board cartridges for each color ink, each off-board reservoir will, after each intervention, hold at least (N−1)/N of its maximum capacity. If N=2, for example, and the volume of ink sufficient to print 20,000 prints is divided equally between the cartridges, operator intervention to replenish the ink reservoirs will be required no more often than every 10,000 prints, or approximately one-half as often as the average interval in the prior art, when printing takes place in four colors.

Still another object of the invention is to provide a method of supplying ink to an ink jet printhead having on-board reservoirs therein for holding inks of different colors, the method comprising: (1) providing an off-board ink reservoir for each color ink, each reservoir comprising a plurality of off-board cartridges; (2) for each color ink, supplying ink to the on-board reservoir from a first off-board cartridge until the first off-board cartridge is empty, then supplying ink to the on-board reservoir from a second off-board cartridge until the second off-board cartridge is empty, and so on until all off-board cartridges holding ink of the same color are empty, and, (3) when all off-board cartridges holding ink of one color are empty, replacing all empty off-board cartridges regardless of the color ink they held.

Other objects and advantages of the invention will become evident upon consideration of the following description and the accompanying drawings.

BRIEF DESCRIPTION OF THE DRAWINGS

FIG. 1 is a front view of a printing device looking in the direction in which paper is fed, and illustrating the positioning of the off-board ink cartridges;

FIG. 2 is a schematic diagram of a portion of an ink supply system according to the present invention, the diagram showing an off-board reservoir and an on-board reservoir for storing one color ink only;

DESCRIPTION OF PREFERRED EMBODIMENTS

Figure 3:
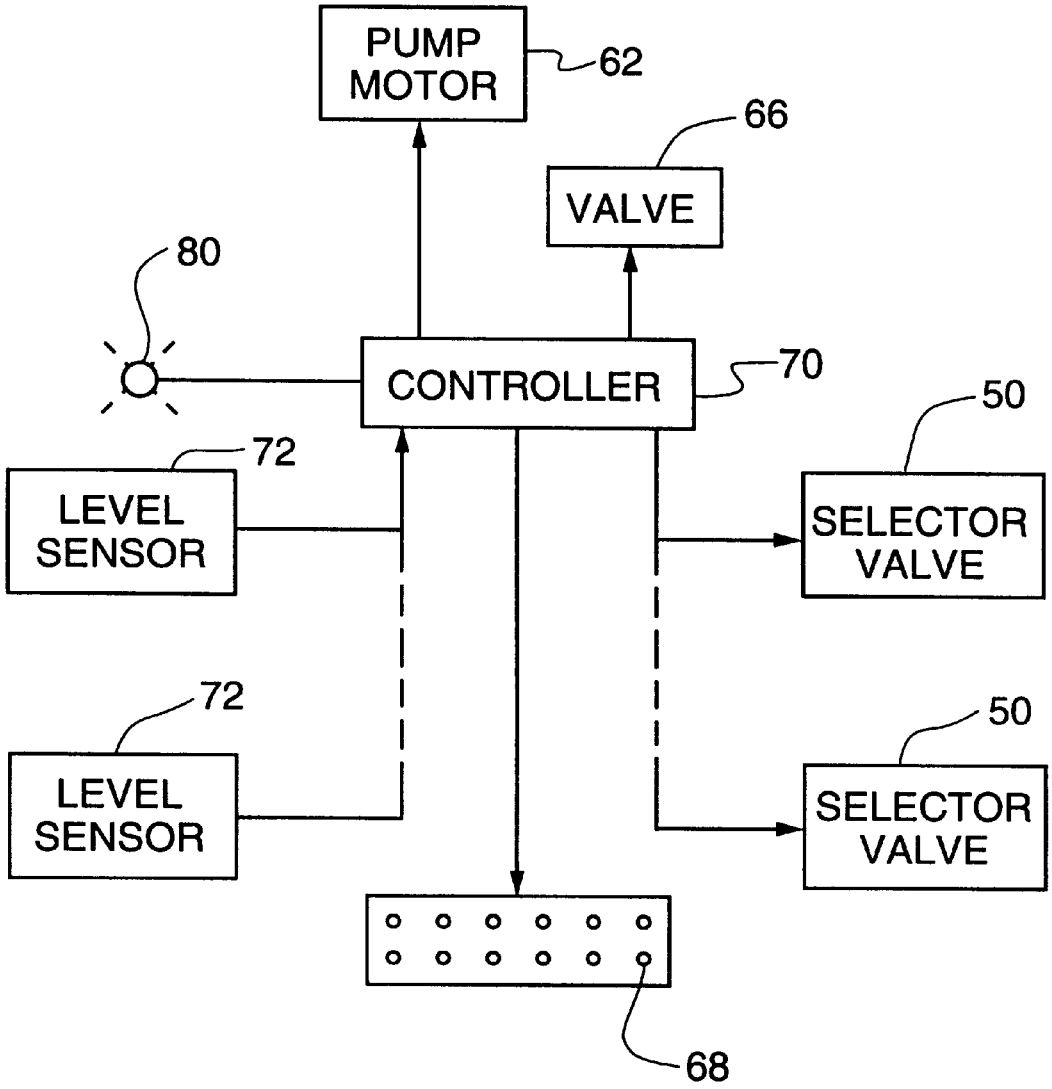
FIG. 3 shows a microcomputer controller connected to sense ink levels and control the pump, selector valves and visual indicators of the ink supply system; and, FIG. 4 shows a suitable algorithm executed by the controller of FIG. 3 to control selection of active off-board cartridges and visually indicate the status of empty cartridges.

Referring to FIG. 1, the invention may be used in a conventional ink jet printer or plotter 10 having a printhead 12 mounted on a printhead carrier 14, the carrier being movable back and forth on a support rod or rail 16 by a suitable means, not shown. The carrier moves transverse to the direction in which a record medium 18, such as a sheet of paper, is fed by a feed mechanism 20. A tray or other holder 22 may be provided for holding a supply of paper.

The printhead 12 preferably comprises a plurality of refillable and disposable ink cartridges 24 having conventional means for ejecting ink from a reservoir 26 (FIG. 2) within the cartridge to accomplish printing. Cartridges 24 may be either continuous refill or intermittent refill type cartridges and the invention is not limited to any particular cartridge design.

The number of cartridges 24 depends on the number of different color inks used in the printing process. If four different inks (black and three colors) are used in printing, then printhead 12 will comprise four cartridges, but if printing takes place in six colors then the printhead comprises six cartridges.

The illustrated embodiment is for printing in six colors: black (K), cyan (C), magenta (M), yellow (Y), orange (0) and green (G). Six off-board ink reservoirs 30 are provided for refilling the reservoirs 26. The off-board reservoirs may be disposed, for example, between feed mechanism 20 and the paper supply 22. In accordance with the invention, each off-board ink supply 30 comprises at least two separately replaceable cartridges 32, 32'.

FIG. 2 illustrates one off-board ink supply 30 for refilling the cartridge reservoir 26 in a single printhead cartridge 24. Ink supply 30 is again illustrated as comprising two replaceable cartridges 32,32' but the reservoir may comprise N cartridges where N is an integer greater than one.

Cartridge 32 comprises a collapsible ink bladder or sac 36 disposed within a hard or rigid exterior shell 38. The shell is provided with two openings 40,42 which are closed by pierceable barriers such as elastic septums 44. A first hollow needle 46 extends through opening 42 and into bladder 36. This needle is connected to an ink supply line or hose 48 which feeds ink to a first input port of an electromagnetically controlled selector valve 50. A second hollow needle 52 extends through opening 40 and is connected to a pressurization line 54 so that pressure may be applied to the interior of the shell, outside of bladder 36, thereby forcing ink out of the bladder and into ink supply hose 48.

Cartridges 32 and 32' are identical and hold the same color ink. Cartridge 32' is connected via an ink supply hose 48' to a second port of selector valve 50. The valve has a third input port vented to atmosphere via a vent line 56, and an output port connected to an ink dispenser line 58. Selector valve 50 is controlled as subsequently described to connect either hose 48 or 48' to dispenser line 58 so that ink may be dispensed into the printhead cartridge reservoir 26. After ink has been dispensed, the valve is switched to connect the vent line 56 to dispenser line 58, thereby permitting ink in the valve and line 58 to drain into the reservoir 26.

FIG. 2 illustrates the line 58 as not directly connected to cartridge 24. This would be the case in intermittent ink supply systems where, to replenish the ink in reservoir 26, cartridge 24 is moved to a refill station where line 58 is located. In this case the line 58 may be terminated with a hollow fixture (not shown) enabling the transfer of ink into the cartridge without spillage. On the other hand, in a continuous ink supply system the line 58 may comprise a flexible hose having an end connected to cartridge 24 so as to move therewith, as illustrated for example in U.S. Pat. No. 5,369,429.

A pressure source or pump 60, comprising a motor 62 driving a bellows 64, provides the positive pressure in pressurization line 54 that is necessary to force ink from bladder 36 or 36', and raise it to the level of the refill station or line 58. An electromagnetically controlled pressure relief valve 66 is provided for releasing pressure in the line 54 when ink is not being transferred from any off-board ink supply 30 to an on-board reservoir 26.

In a preferred embodiment, the pressurization line 54 is connected to the cartridges 32,32' making up all the ink supplies 30 so that only one pressure source 60 is required. Of course a separate pressure source could be provided for each ink supply 30 but this would increase costs and provide additional sources of possible malfunction.

The ink supply system is automatically controlled so that when a first cartridge 32 or 32' in any ink supply 30 becomes empty, the valve 50 controlling flow from that supply is stepped to permit ink flow from the other cartridge. Printing is not stopped at this time but an indicator 68 (FIG. 3), preferably a visual indicator, is set to identify the empty cartridge. When both (all) cartridges making up any ink supply 30 are empty, printing is stopped. An operator may then intervene to replace not only all the cartridges of the empty ink supply but also any cartridges in the other ink supplies which the indicators show to be empty. The indicators may be LED's disposed adjacent the cartridges 32,32', or they may be lights on a control panel.

FIG. 3 shows a controller 70 for controlling the ink supply system. The controller is preferably a microcomputer of conventional design. Controller 70 is connected to the pump motor 62 and the magnet of pressure relief valve 66 and delivers energizing signals to the motor and valve to control the pressurization of line 54. The controller is connected to the electromagnets in selector valves 50 (only two shown in FIG. 3) and provides signals for independently stepping the valves so as to connect a cartridge 32, a cartridge 32', or a vent line 56 to a respective one of ink dispenser lines 58. The controller is also connected to a plurality of ink level sensors 72, only two of the sensors being shown in FIG. 3.

Each printhead cartridge 24 is provided with an ink level determination means for determining when its reservoir 26 is full of ink and when the reservoir is "empty", that is, when the level of ink is so low that the reservoir should be refilled to maintain the ability of the cartridge to reliably print. The ink level determination means may comprise a conventional liquid level sensor 72 (FIG. 2) disposed in the reservoir 26 of each cartridge for producing a first signal when the reservoir is full and a second signal when the reservoir is empty. Alternatively, the ink level determination means may comprise the combination of a conventional liquid level sensor disposed in each reservoir for sensing when the reservoir is full, and an accumulator in controller 70 for accumulating a count of the number of drops of ink the cartridge is instructed to eject from the reservoir during the course of printing. In this case, the accumulator is reset when the reservoir is full and the empty status is inferred when a predetermined number of drops, depending on the volume of the reservoir, have been ejected.

Figure 4:
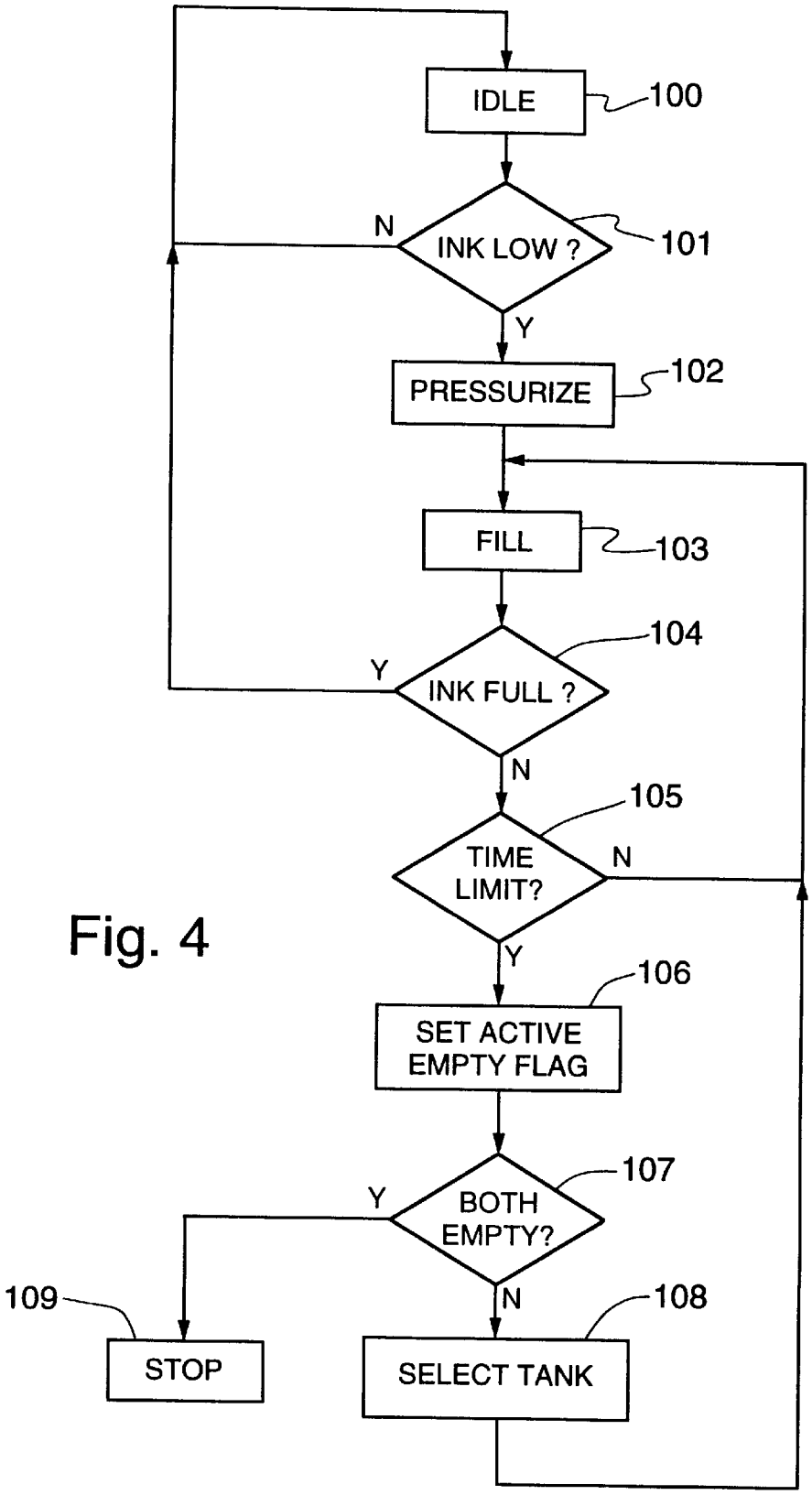

FIG. 4 is a flow diagram illustrating a program routine which may be executed by controller 70 to control the ink supply system. It will be understood that this routine is part of a larger program for controlling the printer, the routine being called by a timed interrupt at regular intervals of a few milliseconds.

Assume that initially the printhead cartridges all have some quantity of ink in them. The controller is in an idle state (100) where it repetitively samples (at 101) the level sensors 72 in every printhead cartridge 24. In the idle state, valves 50 are in positions connecting dispenser lines 58 to atmosphere via vent lines 56. Motor 62 is not being energized and pressure relief is valve 66 is open so that pressurization line 54 is at atmospheric pressure.

Controller 70 remains in the idle state while the printer, in the normal course of printing, ejects ink from printhead cartridges 24. Eventually, the ink supply in one of the reservoirs 26 is depleted to a level where it must be replenished. This condition is detected at program step 101 and the program advances to a pressurization step 102.

The ink supply system represented in FIG. 2 permits the ink reservoirs in all of the printhead cartridges 24 to be refilled at the same time. That is, if the reservoir 26 holding ink of one color must be replenished then all reservoirs may be filled at the same time, thus reducing the loss of print time.

During the pressurization step 102, the controller steps all selector valves 50 so that lines 58 are connected to vent lines 56, thus blocking the ink hoses 48,48'. Relief valve 66 is closed and the controller energizes pump motor 62 to cause some fixed number of pump strokes. The number of strokes is dependent on such factors as stroke length, the volume of bellows 64, etc.

After line 54 has been pressurized, the ink supplies in reservoirs 24 are replenished (step 103) from off-board ink supplies 30. The controller always maintains an Active flag and an Empty flag associated with each of the cartridges 32,32' holding each color ink, these flags being saved in a non-volatile memory when power is off so that they are never lost. If an Active flag is ON it signifies that its associated cartridge is the one currently serving as the source for supplying replenishment ink to a reservoir 26. At step 103 the controller uses the Active flags to set the selector valves 50 so that the active cartridge 32 or 32' for each color is connected to a respective dispensing line 58. As soon as the selector valves 50 are set, the pressure in line 54, acting against the bladders 36 in the cartridges, forces the different color inks from the active cartridges, through valves 50 and lines 58 into reservoirs 26.

During the fill operation carried out at step 103, the controller 70 intermittently energizes motor 62 to stroke pump 60 and maintain the pressure in line 54. Also, the controller monitors (step 104) the level of ink in each reservoir 26 by sampling sensors 72 to determine if a reservoir is full. When a reservoir 26 is full, the selector valve 50 controlling ink flow to that reservoir is switched so that the input ports of the valve connected to hoses 48,48' are blocked and dispensing line 58 is connected to vent line 56.

Filling of the other reservoirs 26 continues and as each reservoir is filled to its capacity its associated valve 50 is switched to terminate ink flow and connect the dispensing line 58 to the vent line 56.

The controller 70 includes a refill timer which is restarted when the fill operation (step 103) is initiated and measures how long the fill operation has continued. The purpose of this timer is to determine when an active off-board cartridge 32,32' is empty. While reservoirs 26 are being refilled, the value in the timer is compared (step 105) with a threshold value representing the maximum time it should take to replenish the ink in a reservoir 26 even if the ink is at its lowest permissible level. The assumption is that if a reservoir 26 is not filled within the threshold interval then the active off-board cartridge has been fully depleted.

If step 105 determines that the threshold fill time has not expired, the fill operation continues as described above. Assuming that all the active off-board cartridges hold a sufficient quantity of ink to permit refill of all reservoirs 26, the refill operation continues until step 104 detects that all reservoirs are full. The controller returns to the idle state 100 where the stroking of pump 60 is terminated, the selector valve 50 for the last-filled color is switched to its venting position, and the relief valve 66 is opened to de-pressurize the pressurization line 54. The reservoirs 26 in cartridges 24 are now full and the printhead 12 may resume printing.

If step 104 should detect that one or more reservoirs 26 are not full and step 105 determines that the threshold fill time has been exceeded, the active off-board cartridge(s) supplying ink to the non-full reservoir(s) must be empty. In this case the Empty flag(s) for the empty cartridge(s) is/are set (step 106) and the indicator(s) 68 are turned on to visually indicate the empty cartridges. The controller then checks (step 107) to determine if the Empty flags are set for both cartridges 32 and 32' in any color ink supply 30. Considering a single ink supply 30, when the active cartridge Empty flag is on but the Empty flag for the inactive cartridge is off, the selector valve 50 servicing the ink supply is switched (step 108) to permit ink flow from the inactive cartridge (now the active cartridge) to dispensing line 58. At the same time, controller 70 restarts the refill timer, turns off the Active flag for the empty cartridge, and turns on the Active flag for the formerly inactive cartridge. The refill operation then continues as described above.

If step 107 should detect that the Empty flags for both cartridges in a single ink supply 30 are ON, the refill operation is stopped (step 109). The periodic stroking of pump 60 is terminated and relief valve 66 is opened to de-pressurize line 54. All selector valves 50 are set to block ink hoses 48 and 48' while venting lines 58. An indicator 80 (FIG. 3) is turned on to indicate that the ink supply system requires servicing. Guided by the visual indicators 68, an operator may remove all empty off-board cartridges 32,32' regardless of the color ink they held and, depending on the type of cartridge used, replace the entire cartridges or replace only the empty bladders within the cartridges.

Generally speaking, letters and documents are printed using black ink only so that off-board cartridges holding the black ink require more frequent replacement. To partially alleviate this problem, and as shown in FIG. 1, the cartridges 32,32' storing black ink (K) are made larger than the cartridges holding inks of other colors. In a practical embodiment, and by way of example only, each black ink cartridge may measure 1"×4"×10" and hold 500 ml while the other cartridges may measure 1"×2.5"×10" and hold 300 ml each.

It should be evident that after replacement of the empty cartridges (or bladders), an ink supply system having off-board ink supplies 30 comprising two cartridges will have, for each color ink, an off-board supply of ink which is at least ½ the maximum capacity of the reservoirs. Therefore, the ink supply system will not require replacement of the off-board cartridges any more frequently than the time required to consume one-half the total supply of any color ink. This is in contrast to prior art printers wherein the total supply of ink for each color is contained in a single cartridge and, after replacement of a cartridge holding one color ink, replacement of a cartridge holding another color ink may be required even on the next sequential page.

For purposes of comparing the present invention with the prior art, two computer models were established for printing taking place in four colors. In one model, representing the prior art, the off-board reservoirs were assumed to be single cartridges, the black ink cartridge holding 515 cc of ink and the color ink cartridges each holding 604 cc. Page printing was assumed to take place in a mix of 14% black, 68% color, and 18% mixed black and color. This model indicated that during the course of printing one-million pages, 176 operator interventions would be required to replenish ink supplies if, at each intervention, only the empty cartridge was replaced.

In the second model, corresponding to the present invention, the black ink reservoir was assumed to comprise two cartridges each holding 257.5 cc of ink and the color ink reservoirs two cartridges each holding 302 cc of ink. Printing was assumed to take place in the same color mix as the first model. It was assumed that intervention takes place only when both cartridges holding a single color ink are empty, and at each intervention all empty cartridges are replaced regardless of the color ink they held. This model indicated that 75 operator interventions would be required to replenish ink supplies during the course of printing one million pages.

According to the particular models chosen, a system according to the present invention requires only 75/176= 42.6% of the number of interventions required by the prior art system. This percentage will vary depending upon the mix of colors being printed and, assuming two cartridges per reservoir, reaches a maximum of 100% when all printing takes place in one color, say black.

A preferred embodiment has been described in detail to illustrate the principles of the invention. However, various modifications and substitutions may be made in the described embodiment without departing from the spirit and scope of the invention as defined by the appended claims. For example, there are some color cartridges having four reservoirs so that a single cartridge 24 is capable of printing in four colors. In this case the printhead 12 may comprise a single on board cartridge, each of the reservoirs in the cartridge being selectively connectable to plural off-board cartridges holding the same color ink. Although the invention is suitable for use with such on board cartridges, it is anticipated that its greatest use will be in network printers having a separate cartridge for dispensing each color ink.

The off-board cartridges 32,32' need not be of the type having bladders therein. A simple box or tank, either filled with foam or unfilled, may be used. However, the illustrated cartridges do have an advantage in that the pressurization of the exterior of the bladders avoids the necessity of tilting the shells toward the septum end to pool ink and improve ink drainage. Also, the sealed and hard exterior shell provides an additional physical barrier to guard against leakage.

Furthermore, the empty status of reservoir cartridges 32,32' maybe determined in various ways that do not require measurement of printhead cartridge fill time as explained with reference to step 105 of FIG. 4. A conventional liquid level sensor may be disposed in each reservoir cartridge, or a conventional flow sensor may be placed in each of the hoses 48,48'. In this case the controller, at step 105, may sample the level sensors or flow sensors to determine which off-board cartridges are empty. The use of liquid level sensors or flow sensors has disadvantages in that more parts are required thus adding to the cost of the system and introducing additional sources of potential failure.

We claim:

1. A method of supplying ink to an ink jet printhead having on-board reservoirs therein for holding inks of different colors, said method comprising:

providing an off-board ink reservoir for each color ink, each reservoir comprising a plurality of off-board cartridges;

for each color ink, supplying ink to the on-board reservoir from a first off-board cartridge until the first off-board cartridge is empty, then supplying ink to the on-board reservoir from a second off-board cartridge until the second off-board cartridge is empty, and so on until all off-board cartridges holding ink of the same color are empty, and, when all off-board cartridges holding ink of one color are empty, replacing all empty off-board cartridges regardless of the color ink they held.

2. A color ink jet printing device having a printhead mounted on-board a movable printhead carrier for ejecting a plurality of inks of different colors from ink reservoirs in said printhead, a plurality of ink supplies located off-board the printhead carrier, each of said ink supplies supplying ink of one of said colors to a respective one of said ink reservoirs, said ink supplies each comprising N separately replaceable off-board cartridges all holding the same color ink, N being an integer greater than one, N indicators, each associated with a respective one of said off-board cartridges, for indicating when said off-board cartridges are empty, whereby, when all of the off-board cartridges holding ink of one color are empty, an operator may identify and replace all empty cartridges regardless of the color of ink they held.

3. A color ink jet printing device as claimed in claim 2 wherein said printhead comprises a plurality of disposable printhead cartridges, one of said ink reservoirs being disposed in each of said printhead cartridges.

4. A color ink jet printing device having a printhead mounted on-board a movable printhead carrier for ejecting a plurality of inks of different colors from ink reservoirs in said printhead, a plurality of ink supplies located off-board the printhead carrier, each of said ink supplies supplying ink of one of said colors to a respective one of said ink reservoirs, said ink supplies each comprising N separately replaceable off-board cartridges all holding the same color ink, N being an integer greater than one, N indicators, each associated with a respective one of said off-board cartridges, for indicating when said off-board cartridges are empty, whereby, when all of the off-board cartridges holding ink of one color are empty, an operator may identify and replace all empty cartridges regardless of the color of ink they held, a plurality of valves, each valve having an output through which ink may flow to one of said ink reservoirs and inputs connected to all of said off-board cartridges of one of said ink supplies, and control means for determining when one of said off-board cartridges is empty, said control means including means for switching the one of said valves connected to the empty off-board cartridge from said empty off-board cartridge to another off-board cartridge in the same ink supply as said empty cartridge.

5. A color ink jet printing device as claimed in claim 4 wherein said control means including means for turning an indicator on when its associated off-board cartridge is empty.

6. A color ink jet printing device as claimed in claim 4 wherein said control means includes means for determining when all said off-board cartridges in one of said ink supplies are empty.

7. A color ink jet printing device as claimed in claim 4 wherein said control means includes an ink level sensor disposed in each of said ink reservoirs.

8. A color ink jet printing device as claimed in claim 4 wherein said control means comprises means for determining that an empty ink reservoir is not full at a predetermined time after said one of said valves is switched.

9. A color ink jet printing device as claimed in claim 4 and further comprising a pressure source connected to all of said off-board cartridges for selectively applying a pressure thereto to force ink from said off-board cartridges and through said valves.

10. A color ink jet printing device having a printhead comprising a plurality of on-board cartridges mounted on-board a movable printhead carrier, each cartridge having therein an ink reservoir from which ink is ejected during printing, each reservoir holding ink of a different color, and an ink supply system for refilling the reservoirs in the on-board cartridges, said ink supply system comprising, for each of said on-board cartridges, an off-board ink supply comprising at least a first and a second off-board cartridge for holding ink of the same color, each off-board cartridge having an associated visual indicator for indicating when it is empty;

a valve having first and second inputs connected to the first and second off-board cartridges and an output connected to a dispensing line through which ink flows to the ink reservoir of the on-board cartridge;

first means for determining when the reservoir in the on-board cartridge is full of ink and when ink in the reservoir therein has reached a refill level at which refilling of the reservoir should be initiated; and a controllers said controller including, second means for determining when an off-board cartridge is empty, third means, responsive to said first means when the reservoir in the on-board cartridge has reached said refill level, for switching the valve so that ink may flow from the first off-board cartridge to the dispensing line, and fourth means for turning on the indicator associated with the first off-board cartridge and switching the valve so that ink may flow from the second off-board cartridge to the dispensing line if the second means determines that the first off-board cartridge is empty.

11. A color ink jet printing device as claimed in claim 10 wherein said control means, comprises means for determining if all off-board cartridges holding ink of the same color are empty and, if so, stopping printing.

12. A color ink jet printing device as claimed in claim 11 wherein each valve has a third input vented to the atmosphere so as to permit ink to drain from said dispensing line when neither off-board cartridge is connected to said dispensing line.

13. A color ink jet printing device as claimed in claim 12 and further comprising a pressure source for applying pressure to said off-board cartridges so as to force ink from one of said off-board cartridges through said valve.

14. A color ink jet printing device as claimed in claim 13 wherein a single pump serves as the pressure source for all off-board cartridges in said ink supply system.

* * * * *